United States Patent [19]

Shinno

[11] Patent Number: 4,669,437

[45] Date of Patent: Jun. 2, 1987

[54] GOVERNOR DEVICE FOR AN AIR-FUEL MIXTURE SUCTION TYPE ENGINE

[75] Inventor: Yoshio Shinno, Sakaishi, Japan

[73] Assignee: Kubota Ltd., Osaka, Japan

[21] Appl. No.: 827,414

[22] Filed: Feb. 10, 1986

[51] Int. Cl.[4] ..... F02D 9/00

[52] U.S. Cl. ..... 123/376

[58] Field of Search ..... 123/332, 373, 376, 392

[56] References Cited

U.S. PATENT DOCUMENTS

| | | | |
|---|---|---|---|
| 2,382,952 | 8/1945 | Armstrong | 123/376 |
| 2,968,193 | 1/1961 | Frick | 123/332 |
| 3,028,848 | 4/1962 | Catterson | 123/376 |
| 3,749,069 | 7/1973 | Reese | 123/376 |
| 3,787,289 | 1/1974 | Pfister | 123/392 |

FOREIGN PATENT DOCUMENTS 59-3162 1/1984 Japan .

*Primary Examiner*—William A. Cuchlinski, Jr.

*Attorney, Agent, or Firm*—Schwartz, Jeffery, Schwaab, Mack, Blumenthal & Evans

[57] ABSTRACT

The present invention relates to the technology to make use of the governor housing in the governor device for the air-fuel mixture suction type engine in common to that of a diesel engine. In the governor device of the present invention, the cover plate for closing the square hole formed in the governor housing is provided with the support hole, through which the shaft portion of the intermediate actuating lever is supported pivotably. The governor lever provided within the governor housing is linked to the throttle valve through the intermediate actuating lever. Therefore, in case that the cover plate to support the intermediate actuating lever is attached to the square hole, the governor housing can be utilized for the air-fuel mixture suction type engine. And in case that the cover plate to support the speed setting lever is attached to the square hole, the governor housing can be utilized for the diesel engine.

4 Claims, 3 Drawing Figures

GOVERNOR DEVICE FOR AN AIR-FUEL MIXTURE SUCTION TYPE ENGINE

BACKGROUND OF THE INVENTION

1. Field of the Invention

The present invention relates to a technology of a governor device for an air-fuel mixture suction type engine, and more particularly relates to a governor device which is constructed so as to control the opening degree of a throttle valve in an air-fuel mixing device by a force difference between a tension force of a governor spring and a flyweight output of a governor weight unit, which is arranged within a governor housing fixed onto a cylinder block of the above mentioned type engine.

2. Prior Art

Generally, in a governor device for an airfuel mixture suction type engine in which an airfuel mixture, Produced by such a mixing device as a carburetore or a mixing unit and then sucked into a combustion chamber, is ignited by a spark-ignition device to combust, due to the fixation of the mixing device onto the end portion of an intake manifold protruded sidewards from the engine body, a governor weight unit is disposed within a governor housing formed in the proximity of the mixing device and the throttle valve of the mixing device is connected by a rod to the intermediate actuating lever supported through the governor housing.

Recently, it has been requested for the engine manufacturing cost to be reduced. In order to attain the cost reduction, it is intended to make use of the engine bodies of an air-fuel mixture suction type engine and a diesel engine in common and enhance the mass-productivity thereof.

However, since the governor weight unit in the diesel engine is disposed within the governor housing formed in the proximity of the fuel injection pump with being linked interlockingly to the pump, the engine body provided with the governor housing formed like that can not be utilized as it is as the engine body of the air-fuel mixture suction type engine in which the governor weight unit is disposed within the governor housing, the mixing device controlled by the governor weight unit is arranged in a position except the engine body and the intermediate actuating lever is supported through the housing.

Therefore, as the engine bodies for both type can't be utilized in common, the manufacturing cost reduction by enhancing the mass-productivity thereof can't be attained.

SUMMARY OF THE INVENTION

The present invention is directed to solving the problems noted above, and has the object to enhance the mass-productivity by making use of the governor housings of both the air-fuel mixture suction type engine and the diesel engine in common.

In a diesel engine, the tension force of the governor spring within the governor housing is controlled by means of the regulating lever outside the governor housing. And the regulating lever is supported pivotably with its shaft portion set through the support hole provided in the cover plate which is fixed over the square hole formed in the governor housing. The regulating lever consists of the shaft portion, the operation lever connected to the outer end of the shaft portion and the spring holding lever connected to the inner end thereof. By cotrolling the operation lever, the tension force of the governor spring is regulated through the shaft portion and the spring holding lever and then the engine speed(rpm.) is controlled.

In this manner, in the diesel engine the supporting hole for Pivotably supporting the shaft portion of the regulating lever is formed in the cover plate.

But the regulating lever to be supported in the support hole and the governor spring are not utilized in the air-fuel mixture suction type engine.

From that point of view, in the governor device of the present invention, the support hole for the shaft portion of the intermediate actuating lever is formed in the cover plate closing the square hole of the governor housing, and in the governor housing there is not provided the support hole. Accordingly, the present invention has the advantageous feature that the governor housing can be utilized in common for that of the diesel engine by forming it so as to be used also in the diesel engine.

Therefore, the present invention is characterized in that the intermediate actuating lever is supported pivotably with its shaft portion set through the support hole provided in the cover plate which closes the square hole formed in the governor housing, the governor lever actuated by the governor weight unit is supported pivotably within the governor housing with its outer end being linked to the inner arm of the intermediate actuating lever, and the outer arm of the intermediate actuating lever is linked to the throttle valve through a rod.

The foregoing and other objects and attendant advantages of the present invention will be readily appreciated as the same become better understood by reference to the following detailed description when considered by the accompaning drawings, wherein:

DETAILED DESCRIPTION OF THE PREFERRED EMBODIMENTS

Figure 1:
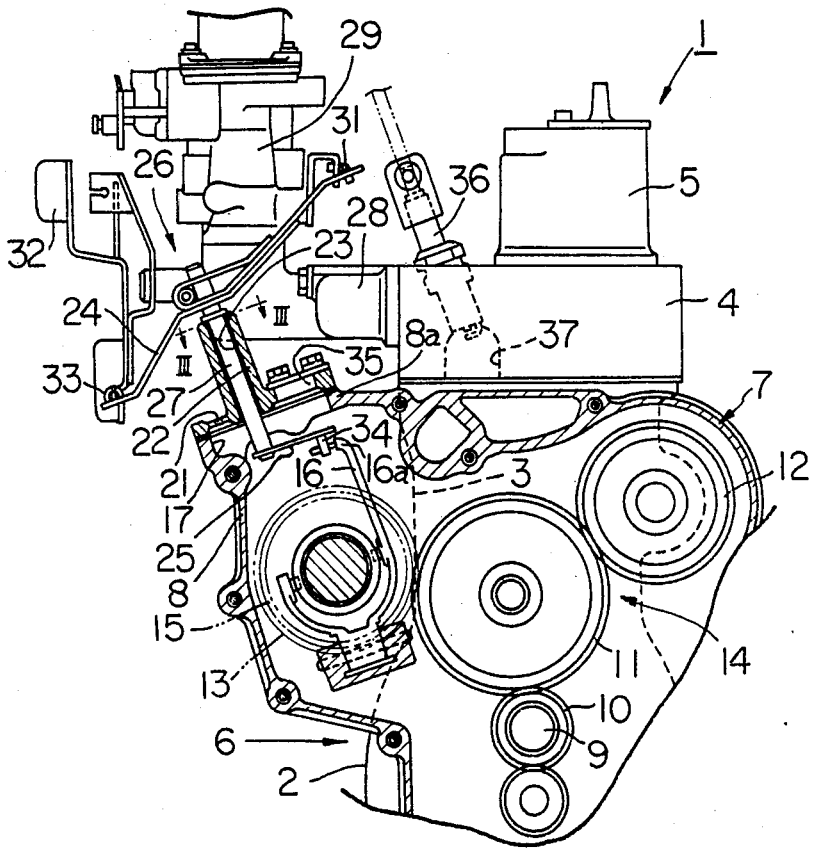
FIG. 1 is an elevational view in vertical section showing the principal part of a preferred embodiment of a vertical water-cooled engine.
Figure 2:
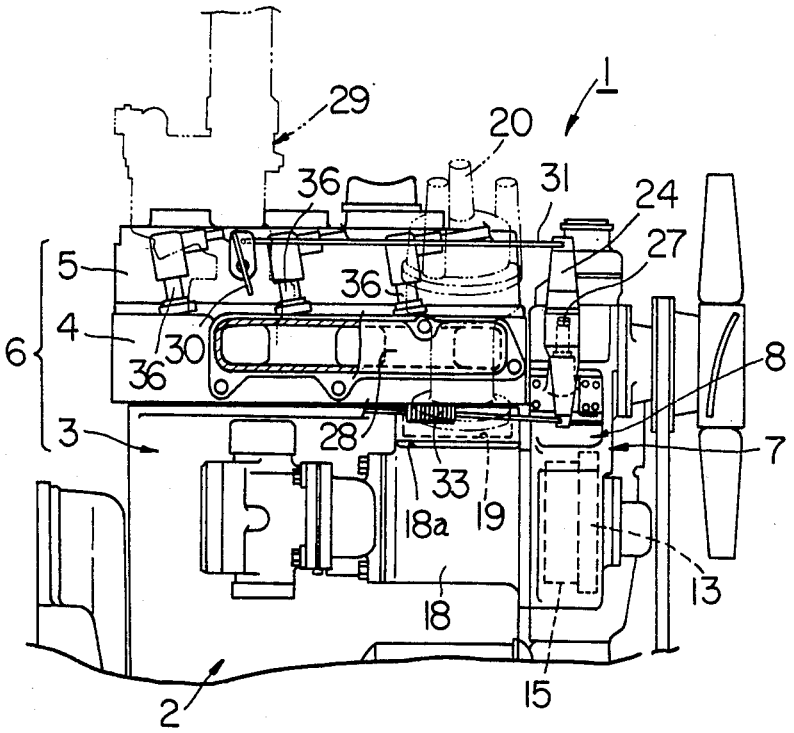
FIG. 2 is a side view partly in section of the engine in FIG. 1.
Figure 3:
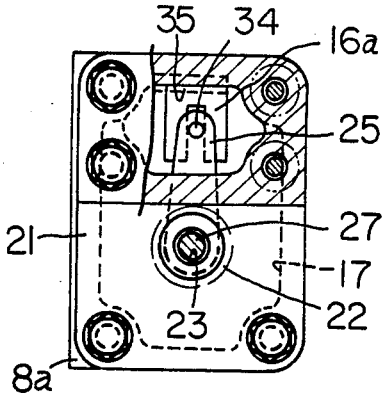
FIG. 3 is a sectional view on line III—III in FIG. 1.

In FIGS. 1, 2 and 3, 1 is an engine( an airfuel mixture suction type engine ), which has a crank case 2 integrated with a cylinder block 3 and a pump case 18 formed integratedly at the upper front portion of the left side wall of the cylinder block 3. An engine bodY 6 is constructed with a cylinder head 4 and a rocker arm cover 5 installed in order onto the cylinder block 3. A governor housing 8 is formed integratedly with a gear case 7 at the upper left portion of the gear case, which is fixed onto the front wall of the engine body 6. And the governor housing 8 covers the pump case 18 from its front side so as to communicate each other.

Within the gear case 7, there are provided a crankshaft gear 10 fixed at the front end of a crank shaft 9 which is supported rotatively in the crank case 2 and a timing power transmission device 14 comprising a camshaft gear 12 and a governor gear 13 driven at the speed reduction of ½ by the crankshaft gear 10 through an intermediate gear 11.

Onto the governor gear 13, there is provided a centrifugal type governor weight unit 15. A governor lever 16 actuated swingably by the output of the governor weight unit 15 is supported pivotably by the governor housing 8.

And in the upper wall 8*a* of the governor housing 8 there is provided a square hole 17. In the upper wall 18*a* of the pump case 18 formed integratedly with the side of the cylinder block 3 at the rearward of the square hole 17, there is provided a pump installation hole 19, in which a distributor 20 is installed as shown in FIG. 2. The square hole 17 formed in the governor housing 8 is closed by a cover plate 21.

Nearly at the center portion of the cover plate 21, there is provided a boss 22 in a standing posture, and the center portion of the boss 22 is bored through to form a support hole 23. An intermediate actuating lever 26 is supported pivotably by the support hole 23 through which the shaft portion 27 thereof is held, and has an outer arm 24 fixed to the upper end of the shaft portion 27 and an inner arm 25 fixed to the lower end thereof. The upper end of the outer arm 24 is linked by a rod 31 to the throttle valve 30 of the carburetor( air-fuel mixing device ) 29 disposed at the end of the intake manifold 28. The lower end of the outer arm 24 is linked to the governor spring 33 of which tension is controlled by the speed setting lever 32. Further the inner arm 25 is engaged to the forked end 16*a* of the governor lever 16 by a pin 34. The pin [° 4 is fixed to the outer end of the inner arm 25 of the intermediate actuating lever 26.

In FIGS. 1 and 3, 35 is a peep hole formed in the cover plate 21 in order to confirm the engagement between the pin 34 and the forked end 16*a* of the governor lever 16 when the cover plate 21 is fixed onto the square hole 17. And in FIGS. 1 and 2, 36 is a spark plug which is supplied with a high voltage from the distributor 20 and attached to the precombustion chamber 37 of each cylinder respectively.

The above-mentioned governor housing 8 in the air-fuel mixture suction type engine is constructed so as to be utilized in common as the governor housing for the diesel engine. When being utilized for the diesel engine, the governor housing 8 is constructed, not shown in Figures but for example as disclosed in Japanese Utility Model Pubrication No. 59(1984)-3162. That is, the governor lever 16 of the governor weight unit 15 is formed so as to be engaged with the control rack of the fuel-injection pump installed in the pump installation hole 19 of the pump case 18, and the cover plate 21 closing the square hole 17 of the governor housing 8 supports the speed setting lever 32 pivotably, which is linked to the governor lever 16 by the governor spring 33. And then the diesel engine body is constructed by connecting the fuel-injection nozzles attached to the precombustion chambers 37 and the fuel-injection pumps installed in the pump case 18 by delivery pipes.

Besides, in the above-mentioned embodiment the governor housing 8 is formed integratedly with the gear case 7. But these governor housing and gear case might be formed by independent parts respectively, and further the governor housing 8 might be integrated with the pump case 18. Still further the air-fuel mixing device 29 formed as the carburetor in the embodiment might be substituted by a fuel-injection nozzle and also by a mixing unit in case of a gas engine.

As described above, in the governor device for the air-fuel mixture suction type engine, since the shaft portion of the intermediate actuating lever is supported pivotably by the support hole formed in the cover plate in view of the supporting construction in the diesel engine wherein the speed setting lever is supported with its shaft portion set through the cover plate fixed onto the square hole of the housing in the diesel engine, it is unnecessary to form the support hole and the boss for supporting the shaft portion of the intermediate actuating lever in the wall of the governor housing when the lever is installed.

Moreover, since the speed setting lever and the governor spring, which are supported by the cover plate in case of the diesel engine, are arranged in the proximity of the mixing device in the air-fuel mixture suction type engine, they are the inoffensive components to the engine even though the cover plate is replaced. And since the cover plate needs not to support the speed setting lever but only needs to support the intermediate actuating lever, there are no such problems occured as the interference between those levers and there are no inconveniences for the engine.

Accordingly, in the governor device for the air-fuel mixture suction type engine of the present invention, the governor housing thereof can be made the same construction as the governor housing, which has not the support hole and the boss thereof, in the diesel engine so as to be utilized in common, and then the mass-productivity can be enhanced to reduce the engine manufacturing cost.

Especially, in case that the governor housing is formed integratedly with such large constructs as the gear case and so on, such large constructs as the gear case integrated with the governor housing also can be made the common parts to the diesel engine, and hence the mass-productivity of those engines can be enhanced more effectively to reduce the manufacturing cost.

I claim:

1. A governor device for an air-fuel mixture suction type engine comprising a governor housing fixed onto a cylinder block of the air-fuel mixture suction type engine and a governor weight unit disposed within the governor housing, and being constructed so as to control the opening degree of a throttle valve in an air-fuel mixing device by a force difference between a flyweight output of the governor weight unit and a tension force of a governor spring, characterized in that said governor housing is provided with a hole, said hole being closed by a cover plate, an intermediate actuating lever being supported pivotably with a shaft portion of said lever being set through a support hole provided in said cover plate, a governor lever 16 actuated by said governor weight unit being supported pivotably within said governor housing, an outer end of the governor lever being linked to an inner arm of said intermediate actuating lever, an outer arm of said intermediate actuating lever being linked to said throttle valve, wherein said cover plate is provided with a peep hole so as to confirm the engagement between said inner arm and said governor lever when said cover plate is attached to said hole.

2. A governor device according to claim 1, wherein the governor housing is integrated with a gear case.

3. A governor device according to claim 1, wherein the hole is formed in the upper wall of the govenor housing.

4. A govenor device according to claim 1, wherein the middle portion of the outer arm of the intermediate actuating lever is fixed to the shaft portion, one end of the outer arm is linked to the throttle valve through a rod and the other end of the outer arm is linked to a speed setting lever through the govenor spring.

* * * * *